US005798681A

United States Patent [19]

Chang

[11] Patent Number: 5,798,681

[45] Date of Patent: Aug. 25, 1998

[54] GARAGE DOOR POSITION INDICATOR

[76] Inventor: Nai-Wen Chang, 21021 Parkridge Dr., Walnut, Calif. 91789

[21] Appl. No.: 700,286

[22] Filed: Aug. 20, 1996

Related U.S. Application Data

[63] Continuation of Ser. No. 524,421, Sep. 6, 1995, abandoned.

[51] Int. Cl.[6] ..... G08B 5/22

[52] U.S. Cl. ..... 340/815.45; 340/686; 340/692; 340/555; 340/539; 49/31

[58] Field of Search ..... 340/815.45, 686, 340/689, 692, 671, 555, 556, 539, 545; 49/25, 31; 250/491.1

[56] References Cited

U.S. PATENT DOCUMENTS

| | | | |
|---|---|---|---|
| 3,445,848 | 5/1969 | Goldstein | 340/539 |
| 4,179,690 | 12/1979 | Nicholls | 340/815.15 X |
| 4,583,081 | 4/1986 | Schmitz | 340/545 |
| 4,734,680 | 3/1988 | Gehman et al. | 340/539 |
| 4,954,810 | 9/1990 | Llewellyn | 340/545 |
| 5,233,185 | 8/1993 | Whitaker | 340/556 |
| 5,313,713 | 5/1994 | Heger et al. | 340/689 X |
| 5,402,105 | 3/1995 | Doyle et al. | 340/539 |

*Primary Examiner*—Jeffery Hofsass
*Assistant Examiner*—Anh La

[57] ABSTRACT

The garage door position indicator contains a radio frequency (RF) transmitter with an electronic angle sensor attached onto a garage door, and a RF receiver with a visual/audio indicator. The electronic angle sensor supplies signals to the RF transmitter during the changes in orientation of a garage door from vertical to horizontal and from horizontal to vertical. The RF receiver is responsive to the RF signals from the RF transmitter and controls a visual/audio indicator to indicate the position of a garage door accordingly.

8 Claims, 9 Drawing Sheets

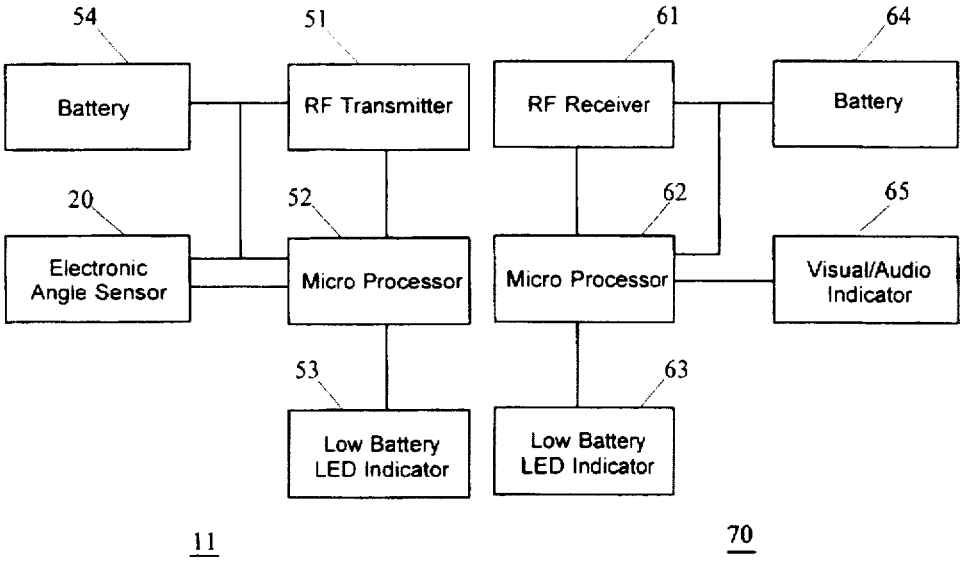
Fig. 5
Fig. 6
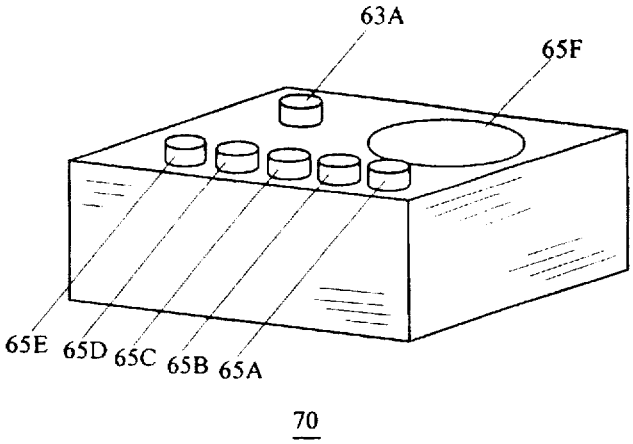
Fig. 6-1

GARAGE DOOR POSITION INDICATOR

This is a continuation of application Ser. No. 08/524,421 filed on Sep. 6, 1995, now abandoned.

REFERENCES CITED

U.S. patent documents

| | | | |
|---|---|---|---|
| 5,402,105 | 3/28/1995 | Matthew P. Doyle | 340/539 |
| 4,583,081 | 4/15/1986 | Schmitz, Charles J. | 340/545 |

BACKGROUND OF INVENTION

The present invention is a garage door position indicator that provides accurate position of a garage door during its operation.

It is necessary to ascertain the position of a garage door at a location out-of-sight whether the door is completely closed, stuck in between, or in motion. It is necessary to have a remote indicator that can be accomplished with easy installation without requiring any alignment, mechanical connection or home wiring.

A garage door status indicating system for use with door operators and control systems is disclosed in U.S. Pat. No. 4,583,081 to Schmitz. A door operator system includes up and down limit switches actuated to the closed position when the door reaches the up and down travel limits. This status indicating system uses a series impedance element common to a pair of LED circuits to prevent actuation of the control circuit by the light emitting devices, which needs to be hard-wired on the existing door operator.

A garage door position indicating system is disclosed in U.S. Pat. No. 5,402,105 to Matthew P. Doyle. An indicating system comprising a tilt (mercury) switch and the use of radio frequency transmitter/receiver to indicate the door position. This system is only capable of indicating two positions—open or close—of the garage door, but not capable of indicating the different positions of the garage door during operation or while it is stuck in between.

SUMMARY OF THE INVENTION

The present invention is an electronic device which comprises a transmitter unit and a receiver unit. The transmitter unit which is attached onto a garage door can detect different positions of a garage door and then send signals to the receiver unit which is placed in a car and/or inside of the house to indicate the accurate positions of a garage door.

Based on the first aspect of the present invention, a garage door position indicator is provided comprising means for detecting accurate position changes of a garage door and supplying signals when the garage door changes orientation from vertical to horizontal and from horizontal to vertical.

Based on the second aspect of the present invention, a garage door position indicator comprises an electronic angle sensor attached to a garage door, the electronic angle sensor is operative to supply signals at each different position of a garage door during its operation, an radio frequency (RF) transmitter coupled to the electronic angle sensor and operative to generate RF signals through a micro processor in response to the signals, an RF receiver responsive to the RF signals, and a visual/audio indicator controlled by the RF receiver through a micro processor to indicate different positions of a garage door during its operation.

The electronic angle sensor comprises infrared transmitting Light Emitted Diodes (IR TX LED), infrared responsive LEDs (IR RX LED), and an encoder panel, such that the IR RX LEDs are to receive infrared pulses from the IR TX LEDs through the holes on the encoder panel during the changes of orientation of a garage door from vertical to horizontal and from horizontal to vertical, and generate signals through a micro processor to a RF transmitter, the RF receiver receives the RF signals and a micro processor in the RF receiver distinguishes the RF signals, and controls a visual/audio indicator to indicate the accurate position of a garage door.

It is an object of the present invention to provide a garage door position indicator with easy installation on any overhead garage door without changing any existing home wiring and also providing accurate position indications of a garage door during its operation.

The present invention can also be further designed and installed with garage door remote controllers and garage door motor systems to become a more complete system for all garage doors. The present invention can also be designed for any other applications that need to remotely detect angles of an object.

BRIEF DESCRIPTION OF THE DRAWINGS

FIG. 5 is a block diagram of the RF transmitter unit.

FIG. 6 is a block diagram of the RF receiver unit for use with the RF transmitter unit.

FIG. 6-1 is a perspective view of the RF receiver unit.

DESCRIPTION OF THE PRESENTLY PREFERRED EMBODIMENTS

Figure 1:
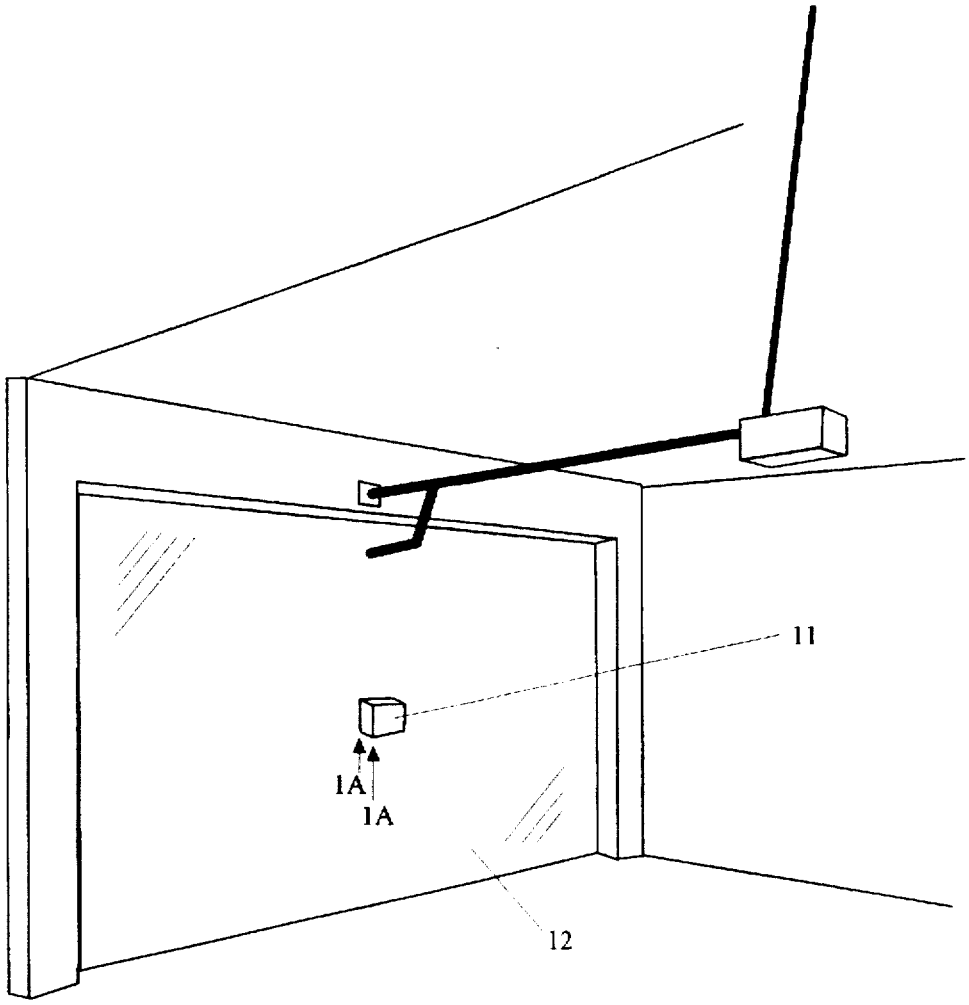
FIG. 1 is a perspective view of an RF transmitter unit mounted on a garage door.
Figure 2:
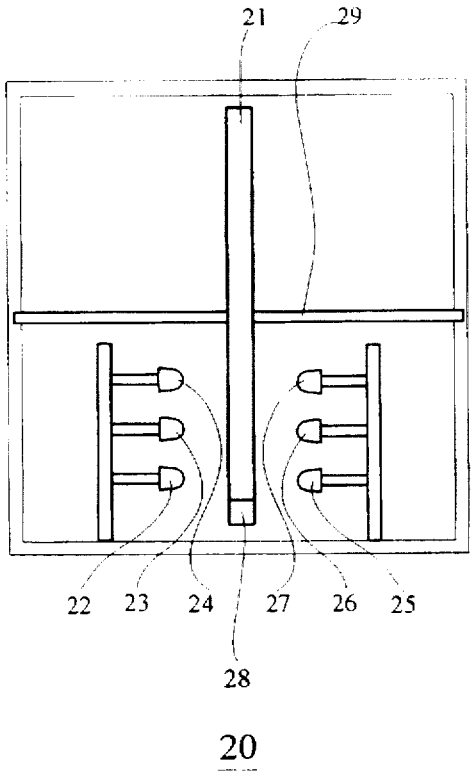
FIG. 2 is a cross-sectional view of an angle sensor in the RF transmitter unit taken along line IA—IA of FIG. A.
Figure 3:
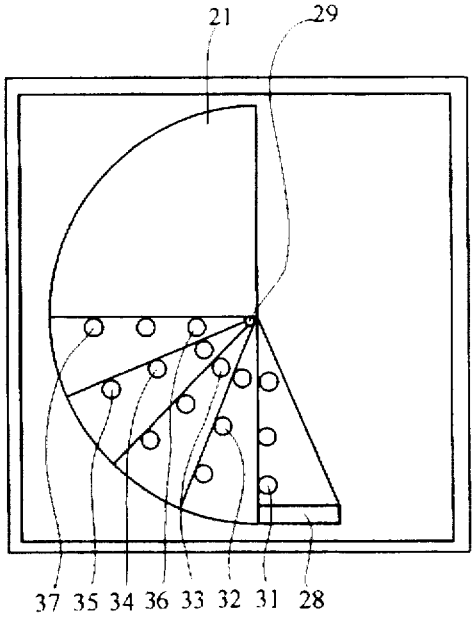
FIG. 3 is a side view of the encoder panel on the angle sensor.
Figure 4:
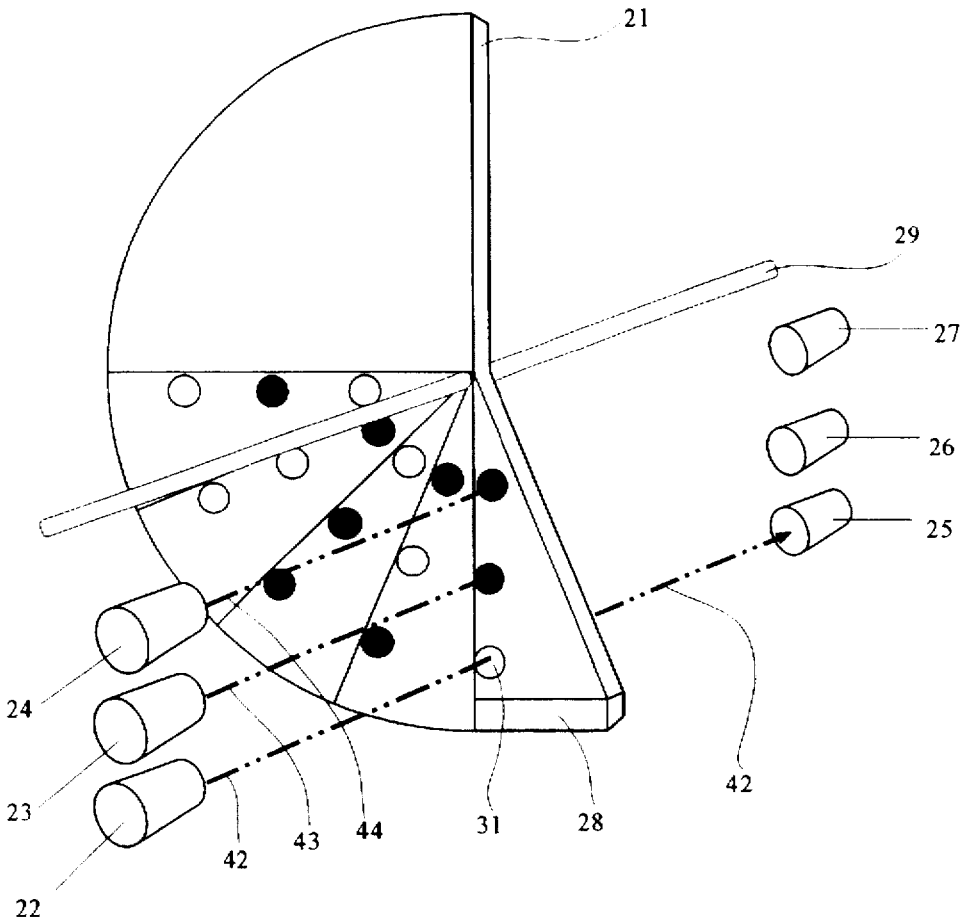
FIG. 4 is a perspective view of the encoder panel with IR TX LED and IR RX LED.
Figure 7:
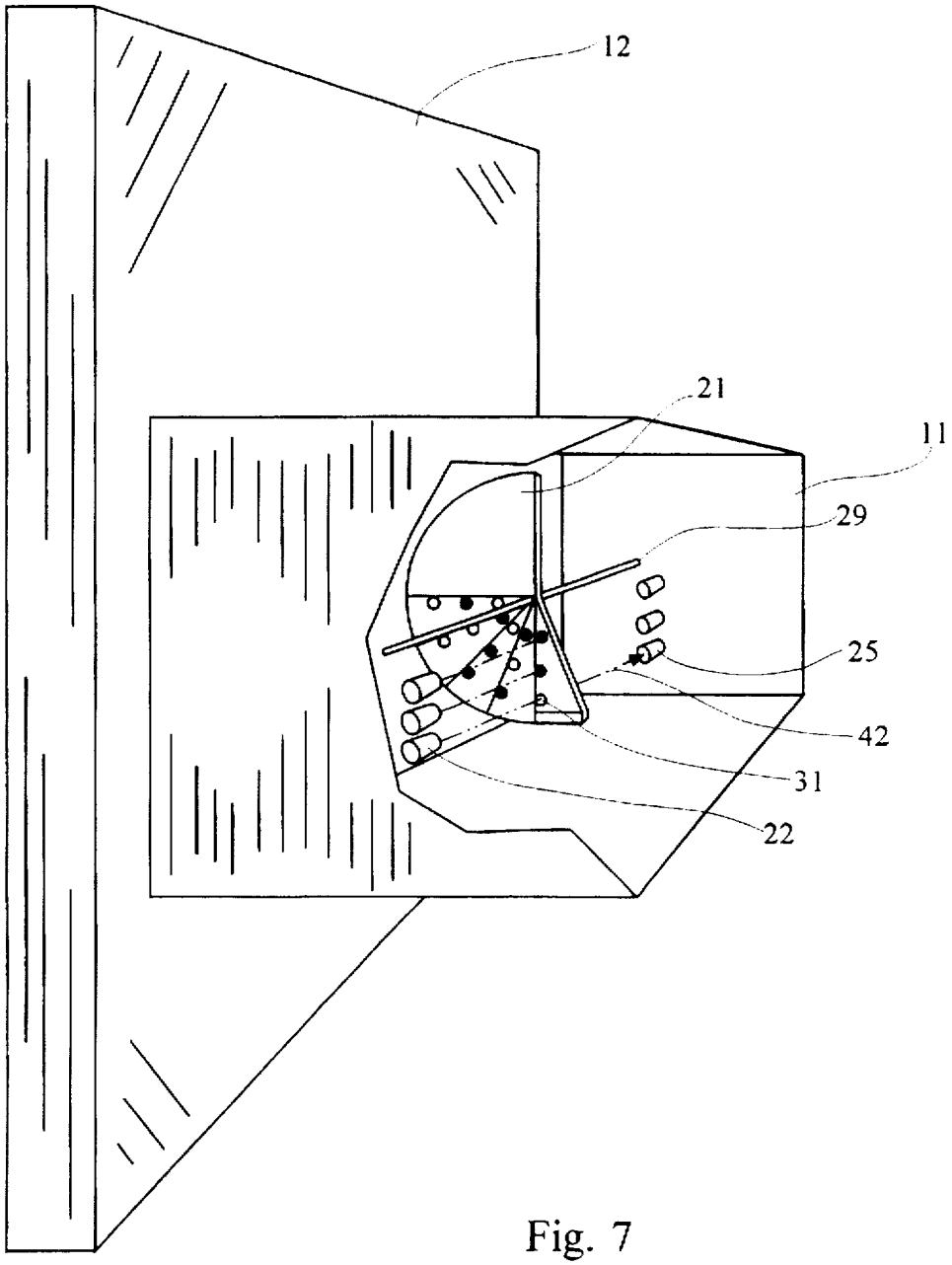
FIG. 7 is a perspective view of the angle sensor in the RF transmitter unit when the garage door is closed.
Figure 8:
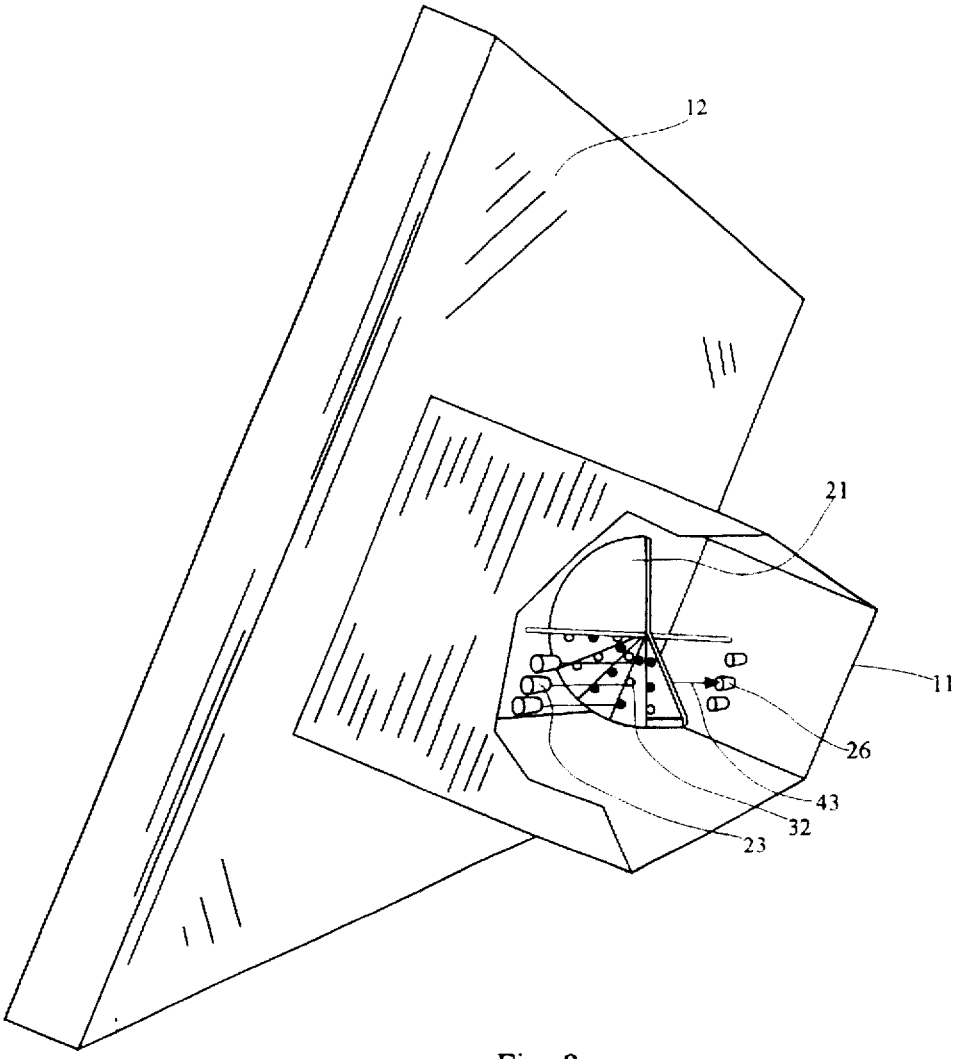
FIG. 8 is a perspective view of the angle sensor in the RF transmitter unit when the garage door is ¼ opened.
Figure 9:
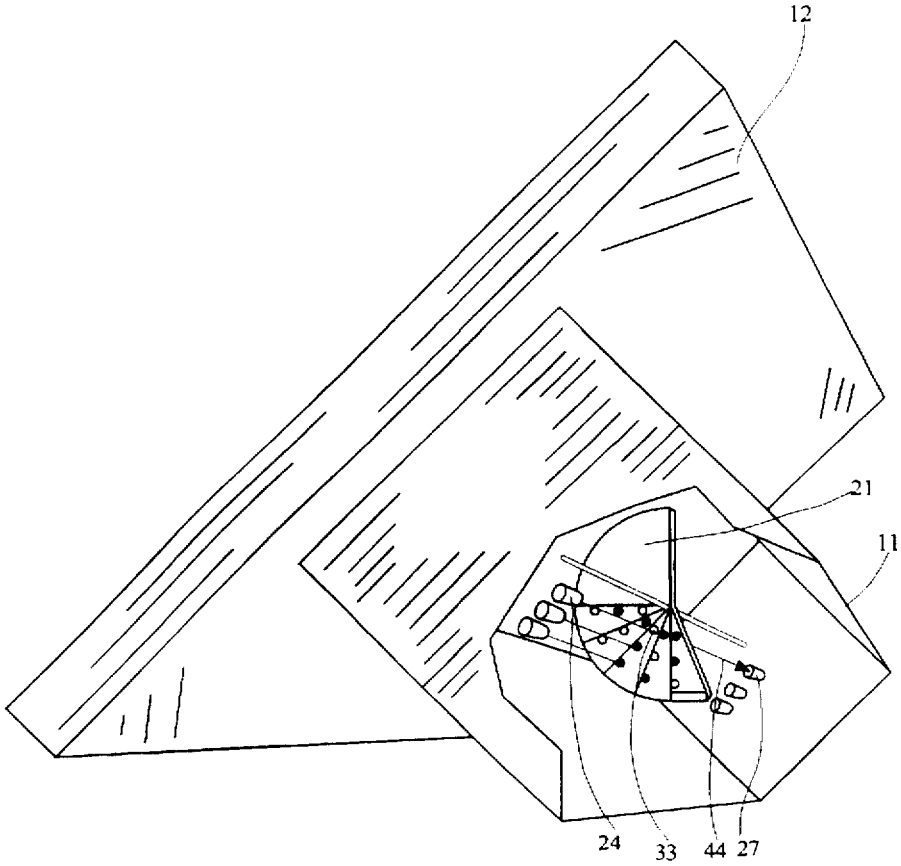
FIG. 9 is a perspective view of the angle sensor in the RF transmitter unit when the garage door is ½ opened.
Figure 10:
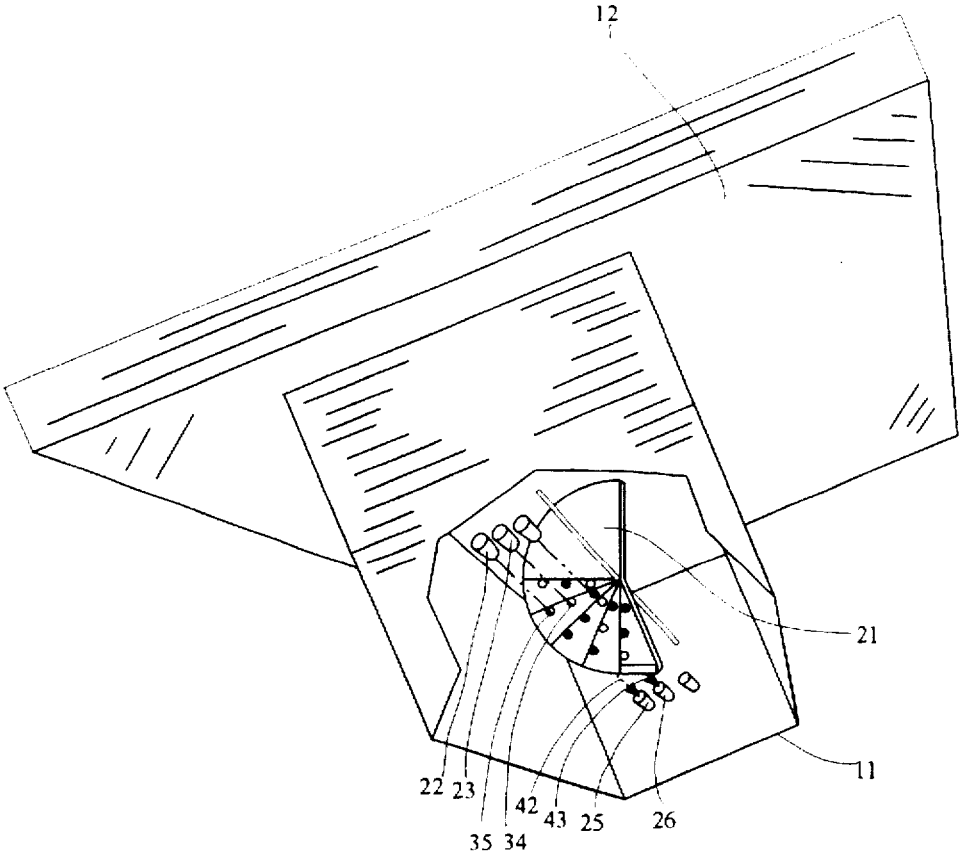
FIG. 10 is a perspective view of the angle sensor in the RF transmitter unit when the garage door is ¾ opened.
Figure 11:
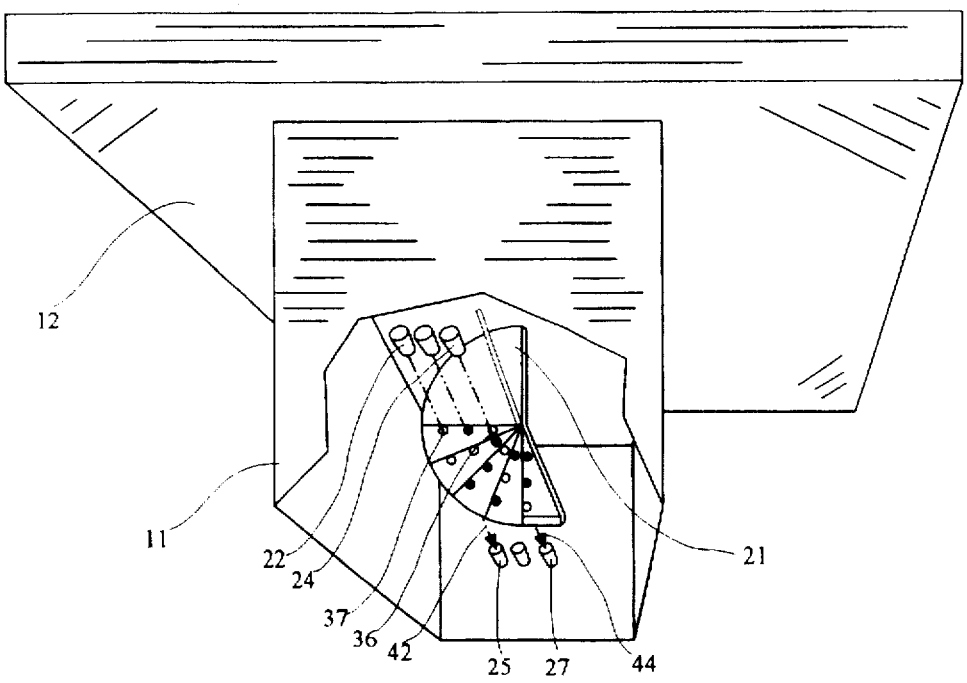
FIG. 11 is a perspective view of the angle sensor in the RF transmitter unit when the garage door is fully opened.

Referring to the figures, FIG. A shows an RF transmitter unit 11 mounted on the inside of a conventional overhead garage door 12. The RF transmitter unit 11 my be easily mounted, fastened, or attached onto the garage door 12 by using screws, Velcro, double-sided adhesive tape, or any other conventional ways.

FIG. B shows an angle sensor 20 enclosed within the RF transmitter unit 11. The angle sensor 20 comprises a encoder panel 21, IR TX LEDs 22–24, and IR RX LEDs 25–27. The encoder panel 21 that has a heavy weight 28 on the bottom is hung by an axle 29, so the encoder panel 21 can be turned smoothly and freely and is always in vertical position due to the force of gravity as shown on FIG. C.

FIG. C & FIG. D show the holes 31–37 that are logically arranged on the encoder panel 21 for the continuous infrared pulses 42–44 from IR TX LEDs 22–24 to pass through some of the holes 31–37 to reach some of the IR RX LEDs 25–27 during the changes of orientation of a garage door 12 from vertical to horizontal or from horizontal to vertical as shown on FIG. G through FIG. L.

FIG. E is the block diagram of the RF transmitter unit 11. The angle sensor 20 is coupled with a micro processor 52 which is capable of reading and distinguishing signals generated by the angle sensor 20, and send RF signals through the RF transmitter 51 during the change of orientation of the garage door 12. The micro processor 52 is coupled with a low battery indicator 53, so that when the micro processor 52 detects insufficient battery power from the battery 54, the micro processor 52 controls the low battery indicator 53 to turn on the LED 63A for indication.

FIG. F is the block diagram of the RF receiver unit 70. The RF receiver 61 is coupled with the micro processor 62 which is capable of reading and distinguishing the RF signals from the RF transmitter 51. The visual/audio indicator 65 is coupled and controlled by the micro processor 62 which generates control signals according to the RF signals received by the RF receiver 61, and the visual/audio indicator 65 will display/sound differently accordingly. The micro processor 62 is coupled with a low battery indicator 63, so that when the micro processor 62 detects insufficient battery power from the battery 64, the micro processor 62 controls the low battery indicator to turn on the LED for indication.

When a garage door 12 is fully closed which is in vertical position, the garage door 12 and the RF transmitter unit 11 are in the position as shown in FIG. G wherein the encoder panel 21 is in vertical position, and only the IR RX LED 25 receives infrared pulses 42 from the IR TX LED 22 through the hole 31 on the encoder panel 21, and generates signals to the micro processor 52 which can distinguish the signals and send RF signals through the RF transmitter 51. The RF receiver 61 enclosed within the RF receiver unit 70 receives the RF signals from the RF transmitter 51, the micro processor 62 coupled with the RF receiver 61 is capable of distinguishing the signals and controls the visual/audio indicator 65 to turn on the GREEN LED 65E and generate a tone to the speaker 65F to sound the position of the garage door accordingly.

When a garage door 12 is ¼ opened, the garage door 12 and the RF transmitter unit 11 are in the position as shown in FIG. H wherein the encoder panel 21 is turned and kept in vertical position due to the force of gravity, so that only IR RX LED 26 receives infrared pulses 43 from the IR TX LED 23 through the hole 32 on the encoder panel 21, and then generates signals to the micro processor 52 and sends RF signals through the RF transmitter 51. When The RF receiver 61 receives the RF signals, the micro processor 62 distinguishes the signals and controls the visual/audio indicator 65 to turn on the YELLOW LED 65D and generate a tone to the speaker 65F to sound the position of the garage door accordingly.

When a garage door 12 is ½ opened, the garage door 12 and the RF transmitter unit 11 are in the position as shown in FIG. J wherein the encoder panel 21 is turned and kept in vertical position due to the force of gravity, so that only IR RX LED 27 receives infrared pulses 44 from the IR TX LED 24 through the hole 33 on the encoder panel 21, and then generates signals to the micro processor 52 and sends RF signals through the RF transmitter 51. When The RF receiver 61 receives the RF signals, the micro processor 62 distinguishes the signals and controls the visual/audio indicator 65 to turn on the ORANGE LED 65C and generate a tone to the speaker 65F to sound the position of the garage door accordingly.

When a garage door 12 is ¾ opened, the garage door 12 and the RF transmitter unit 11 are in the position as shown in FIG. K wherein the encoder panel 21 is turned and kept in vertical position due to the force of gravity, so that the IR RX LED 25 receives infrared pulses 42 from the IR TX LED 22 through the hole 35 on the encoder panel 21 and also the IR RX LED 26 receives infrared pulses 43 from the IR TX LED 23 through the hole 34 on the encoder panel 21, and then generates signals to the micro processor 52 and sends RF signals through the RF transmitter 51. When The RF receiver 61 receives the RF signals, the micro processor 62 distinguishes the signals and controls the visual/audio indicator 65 to turn on the RED LED 65B and generate a tone to the speaker 65F to sound the position of the garage door accordingly.

When a garage door 12 is fully opened, the garage door 12 and the RF transmitter unit 11 are in the position as shown in FIG. L wherein the encoder panel 21 is turned and kept in vertical position due to the force of gravity, so that the IR RX LED 25 receives infrared pulses 42 from the IR TX LED 22 through the hole 37 on the encoder panel 21 and also the IR RX LED 27 receives infrared pulses 44 from the IR TX LED 24 through the hole 36 on the encoder panel 21, and then generates signals to the micro processor 52 and sends RF signals through the RF transmitter 51. When The RF receiver 61 receives the RF signals, the micro processor 62 distinguishes the signals and controls the visual/audio indicator 65 to turn on the RED LED 65A and generate a tone to to the speaker 65F sound the position of the garage door accordingly.

Following is a summary of the changes of orientation of a garage door during its operation:

| Figures | G | H | J | K | L |
|---|---|---|---|---|---|
| Orientation of Garage Door | Fully Closed = 0° | 1/4 opened = 22.5° | 1/2 opened = 45° | 3/4 opened = 67.5° | fully opened = 90° |
| Infrared Pulses pass through | 42 | 43 | 44 | 42,43 | 42,44 |
| Holes on the Encoder Panel which infrared pulses pass through | 31 | 32 | 33 | 34,35 | 36,37 |
| IR RX LEDs which received infrared pulses from IR TX LEDs | 25 | 26 | 27 | 25,26 | 25,27 |
| Codes for the Micro Processor to distinguish signals | 001 | 010 | 100 | 011 | 101 |
| Visual/Audio Indicator | Green LED 65E | Yellow LED 65D | Orange LED 65C | Red LED 65B | Red LED 65A |

As shown on the above summary, the micro processor 52 enclosed within the RF transmitter unit 11 reads and distinguishes the signals from the angle sensor 20 when various IR RX LEDs 25–27 receive infrared pulses 42–44 from various IR TX LEDs 22–24 through various holes 31–37 on the encoder panel during the change of orientation of a garage door from vertical to horizontal or from horizontal to vertical; and the micro processor 62 enclosed within the RF receiver unit 70 reads and distinguishes the various RF signals sent by the RF transmitter 51 during the operation of the garage door, and controls the visual/audio indicator 65 to display/sound differently accordingly as the indication of the different position of the garage door during its operation.

When the garage door 12 is stuck or out of function during its closing operation, and, for example, stopped at an 50° angle, the micro processor 62 which is coupled with the RF receiver 61 in the RF receiver unit 70 received the RF signals from the RF transmitter 51 only when the garage door 12 was fully opened and when the garage door 12 was at its 67.5° during its closing operation, which means only the Red LED 65A and the Red LED 65B in the visual/audio indicator 65 was turned on; another example, if the garage door stopped at an 30° angle, only the Red LED 65A, the Red LED 65B, and the Orange LED 65C was turned on. Which means, if the Green LED 65E on the receiver unit 70 is not turned on during the closing operation, it means the garage door is not fully closed. The visual/audio indicator 65 also generate tones in different frequency to sound the different angles of the garage door 12 accordingly. Thus, the Garage Door Position Indicator has its indicating function of an accurate position of a garage door during its operation.

The present invention described here is using 3 IR TX LEDs 22–24 and 3 IR RX LEDs 25–27 with 7 holes 31–37 on the encoder panel 21 to get 5 different infrared pulses data for micro processors 52, so that only 5 different angles of the garage door 12 is detected during its operation, however, if more accurate detection of the angle of the garage door 12 is necessary, or this invention is to be used for remotely detecting more accurate angles of an objects, more IR TX LEDs and IR RX LEDs can be installed, and more holes will need to be logically arranged on the encoder panel 21 according to the numbers of the IR TX LEDs and IR RX LEDs.

The garage door position indicator described above is very easy to install. The RF transmitter unit 11 is battery powered and may be installed without the use of any complicated tools or any hard-wiring to the existing garage door systems, just simply attach onto the garage door; while the RF receiver unit 70 is also battery powered and can be put in a car, in a house, or anywhere within the range of the RF signals from the RF transmitter unit 11.

The present invention has been described with what is to be the most practical and preferred embodiment, it is to be understand that the invention is not to be limited to the disclosed embodiment, but is intended to cover various modifications and equivalent arrangement included with the spirit and scope of the appended claim, which scope is to be accorded the broadest modifications and equivalent structure.

I claim:

1. An electronic indicator providing indications of changes of position of a garage door, comprising:

a transmitter unit including a housing to be easily attached onto a garage door, the housing enclosing: an electronic angle sensor comprising 3 IR RX LEDs, and encoder panel which is always in vertical position due to the gravity force, and 3 IR TX LEDs; wherein the 3 IR RX LEDs are individually aligned and faced to the 3 IR TX LEDs;

a micro processor coupling to said electronic angle sensor for generating and distinguishing signals when the garage door changes orientation from vertical to horizontal and from horizontal to vertical;

an RF transmitter coupled to said micro processor and responsive to the signals from said electronic angle sensor for transmitting RF signals during the changes of the orientation of the garage door; and a receiver unit including a RF receiver responsive to the RF signals from said transmitter, and another micro processor couples to said RF receiver; an indicating means being activated by said another micro processor when receipt of the RF signals by the receiver, whereby activation of said indicating means indicates the changes of orientation of the garage door during operation.

2. The electronic indicator as defined in claim 1, wherein said encoder panel has 7 holes logically arranged on the panel for infrared pulses from said 3 IR TX LEDs to pass through and reach some of the said 3 IR RX LEDs during the change of orientation of a garage door.

3. The electronic indicator as defined in claim 1, wherein said electronic angle sensor generates signals when some of said 3 IR RX LEDs receive infrared pulses from said 3 IR TX LEDs through 1 or 2 of the 7 holes that are logically arranged on said encoder panel while the garage door changes its orientation.

4. The electronic indicator as defined in claim 1, where in said micro processor in said transmitter unit is capable of distinguishing signals generated by said electronic angle sensor, and is capable of detecting low battery power.

5. The electronic indicator as defined in claim 1, wherein said another micro processor in said receiver unit is capable of distinguishing signals received by said RF receiver from said RF transmitter unit, and is capable of detecting low battery power.

6. The electronic indicator as defined in claim 1, wherein said IR RX LEDs and IR TX LEDs can further be increased to 4 or more pairs, and the holes on said encoder panel can further be increased and logically arranged accordingly for more accurate indication of the changes of position of the garage door during operation.

7. The electronic indicator as defined in claim 1, wherein said indicating means comprises:

a visual indicator including 5 LEDs that are to be activated by said another micro processor coupling to said receiver unit according to the RF signals from said RF transmitter that are generated by said electronic angle sensor, to show 5 different positions of the garage door during its change of orientation; and an audio indicator including a tone generator that are to be activated by said micro processor coupling to said receiver unit according to the RF signals from said RF transmitter that are generated by the electronic angle sensor, to generate 5 different tones representing the 5 different positions of the garage door during its change of orientation.

8. The electronic indicator as defined in claim 1, wherein said transmitter unit is battery powered, and the receiver unit can be battery powered or adapted to be plugged into an electrical socket.

* * * * *